United States Patent [19]

Boltersdorf et al.

[11] 4,330,378

[45] May 18, 1982

[54] ELECTROLYSIS CELL AND METHOD FOR ELECTROLYTIC PRODUCTION OF HYDROGEN

[75] Inventors: Dagmar Boltersdorf, Kreuzau; Robert Junginger, Jülich; Bernd D. Struck, Langerwehe; Herbert Neumeister, Jülich, all of Fed. Rep. of Germany

[73] Assignee: Kernforschungsanlage Jülich GmbH, Jülich, Fed. Rep. of Germany

[21] Appl. No.: 208,933

[22] Filed: Nov. 21, 1980

[30] Foreign Application Priority Data

Nov. 28, 1979 [DE] Fed. Rep. of Germany ..... 2947789

[51] Int. Cl.[3] ..... C25B 1/02; C25B 1/22

[52] U.S. Cl. ..... 204/104; 204/129

[58] Field of Search ..... 204/104, 129, 109

[56] References Cited

FOREIGN PATENT DOCUMENTS

| | | |
|---|---|---|
| 719315 | 12/1954 | United Kingdom . |
| 767103 | 1/1957 | United Kingdom . |
| 781287 | 8/1957 | United Kingdom . |
| 851785 | 10/1960 | United Kingdom . |
| 1292102 | 10/1972 | United Kingdom . |
| 2005308 | 4/1979 | United Kingdom . |

*Primary Examiner*—R. L. Andrews

*Attorney, Agent, or Firm*—Frishauf, Holtz, Goodman & Woodward

[57] ABSTRACT

The production of hydrogen by electrolysis in a cell, in which the anode electrolyte contains sulfur dioxide as well as sulfuric acid and an intermediate chamber separated from the anode and cathode chambers by cation-exchanger membranes is provided through which an electrolyte flows in order to prevent sulfur dioxide from reaching the cathode chamber is greatly improved by using as the anode side membrane a cation-exchanger in which a polyvinyl chloride skeleton is combined with a polymer of styrol and divinyl benzol to which sulfonic acid groups have been attached, such a membrane having a very low resistivity, thus reducing the necessary electrolysis voltage. Such a membrane also loses conductivity with increasing sulfuric acid concentration at a lower rate than membranes previously used in such an electrolysis process and permits a higher sulfuric acid concentration in the anode electrolyte. The improvement on the anode side makes possible the operation of the cathode at low sulfuric acid electrolyte concentration, below 20 or even 10% by weight. Through-flow electrodes of porous graphite encased except on the membrane side by impermeable graphite further improve the operation of the process, especially if they fill the electrolyte chamber right up to the membrane.

17 Claims, 4 Drawing Figures

PVDF (POLYVINILIDENE FLUORIDE)

GRAPHITE

COPPER

ELECTROLYSIS CELL AND METHOD FOR ELECTROLYTIC PRODUCTION OF HYDROGEN

The present invention concerns a process and an electrolysis cell for electrolytic production of hydrogen of the kind in which hydrogen is separated at the cathode and sulfurous acid is oxidized to sulfuric acid at the anode, while the anode chamber is separated from the cathode chamber by an intermediate chamber bounded by cationic exchange membranes serving as separators. A separation electrolyte flows through the intermediate chamber and the three chambers are provided with electrolyte flows, the respective concentrations of which have a certain determined relation.

The production of hydrogen by cathodic separation from an aqueous medium is of particular significance in connection with the sulfuric acid hybrid recycling process for production of hydrogen and oxygen. In this process, the hydrogen is obtained by electrolysis, while sulfuric acid is formed at the anode which thereafter is catalytically decomposed at high temperature with recovery of $SO_2$ and $O_2$. The decomposition reaction takes place with concentrated sulfuric acid that is obtained from the aqueous sulfuric acid solution of the electrolysis, for which reason the sulfuric acid concentration in the electrolyte should be as high as possible. Nevertheless, in view of its reduced conductivity and poor electrochemical kinetics, particularly high sulfuric acid concentrations are counterproductive. At the present time, sulfuric acid concentrations of about 50% by weight in the anode chamber are regarded as optimal.

An important problem of the above-outlined electrolysis process arises because care must be taken by provision of as high a conductivity as possible for all components in order that the electrolysis voltage may be as low as possible, while on the other hand $SO_2$ must be prevented from proceeding from the anode chamber over to the cathode and there being reduced to sulfur, which would lead to a rapid poisoning of the active cathode layer.

In order to prevent such poisoning, there has been developed by the assignee of the present application a process (described in U.S. Ser. No. 945,693, filed Sept. 25, 1978) in which process the anode chamber is separated from the cathode chamber by an intermediate chamber through which a sufficient electrolyte flow is provided for a continuous carrying away of the sulfur dioxide that crosses over into the intermediate chamber from the anode chamber. In the intermediate chamber, there is preferably provided a certain overpressure that produces an electrolyte transport through the separating membrane from the intermediate chamber into the anode space that opposes the possible $SO_2$ migration just mentioned. Cationic exchange membranes and diaphragms are suggested as separating membranes between the anode and intermediate chambers and between the cathode and intermediate chambers.

In practice, it has now been found that the optimizing of such electrolysis cells runs into difficulties because the internal resistance of the three-chamber electrolysis cell utilizing two separators is very high. Cation exchange membranes, the use of which in itself would be desirable, in order to prevent a mixing of the various electrolytes of the anode, cathode and intermediate chambers, appeared to be unsuitable because of the area resistance ($\Omega$ cm$^2$) or the specific resistance ($\Omega$ cm) (resistivity) of the heretofore used membranes that are substantial and very heavily dependent upon the concentration of the surrounding aqueous electrolytes. Porous diaphragms provide no satisfactory separation of the various chambers, especially under the unavoidable pressure differences.

The Invention

It is accordingly an object of the present invention to obtain an optimization carried as far as possible for such cells and processes, with particular interest in an internal resistance of the cell that is as small as possible with concurrent mitigation or prevention of $SO_2$ migration into the cathode chamber, and to provide a structural constitution of the cell that permits an optimal product yield.

Briefly and primarily, a special cation exchanger membrane is utilized on the anode side that has a conductivity corresponding to a specific resistance that is less than about 30 ohm-centimeters at 80° C. in sulfuric acid of 55% by weight concentration.

A kind of cation exchange membrane that fulfills these conditions and should be designated as a heterogeneous ion exchange membrane, is described for example in U.S. Pat. No. 3,451,951. Such heterogeneous ion exchange membranes consist basically of two different polymer materials of which one is constituted as an ion exchanger. This ion exchanger component is distributed over the membrane wall and when the ion exchanger component is dissolved out, it leaves behind a porous structure of the skeleton polymers, as experiments have shown (see Y. Mizutauy, Bull. Chem. Soc. Japan 42 (1969) 2459–63 and 43 (1970) 595–97). Membranes of polyvinyl chloride as the skeleton component, containing sulfonated poly(styrol/divinylbenzol) as ion exchanger component, have been particularly tested and studied. A commercial product that has proved to be particularly suitable is known as Neosepta® C66-5T.

The conductivity of such cation exchanger membranes diminishes less strongly with increasing concentration of the surrounding aqueous sulfuric acid than the conductivity of the previously used homogeneous cation exchanger membranes of the perfluorinated poly(ethylene/ethylene oxide) provided with sulfonic acid groups. This property is particularly favorable for the hydrogen production field of application to which the present claims are directed, within the broader field of the so-called sulfuric acid hybrid process of electrolysis.

It is true that the mechanical strength of such membranes is less than the particular known homogeneous cation exchanger membranes, but it has been found in practice that continuous operation of considerable duration is possible with such materials, as has been confirmed by a 300-hour experiment.

The membrane's low internal resistance and relatively slight conductivity dependence on the concentration of the surrounding electrolyte, when provided on the anode side for a three-chamber cell utilizing cation exchanger membranes as separators leads not only to an improvement of the electrolysis voltage (attributable to the favorable conductivity of the membrane itself), but also encompasses the possibility of optimization at the anode side by the use of a flow-through electrode adjacent to the membrane, as well as particularly high sulfuric acid concentrations in the anolyte, which is particularly suitable for the sulfuric acid hybrid process. The juxtaposition of a flow-through anode is not possible with the porous diaphragm heretofore used on the anode side for obtaining suitable conductivity values, because the overpressure in the flow-through electrode that is present at the diaphragm can lead to mixing with the electrolyte in the adjacent chambers.

The separation of the different liquids in the various chambers of the electrolysis cell that is obtained by the cation exchanger membranes offers the further possibility of providing optimal sulfuric acid concentrations in the separation or intermediate chamber. These concentrations lie between about 25 and 45% by weight of sulfuric acid and particularly at about 30% by weight $H_2SO_4$.

The possibility obtainable in the same case for the use of lower electrolyte concentrations in the cathode chamber, which can be provided by sulfuric acid concentrations of less than about 20% by weight, and particularly between 0 and 10% by weight, has the considerable advantage that the cathodic by-product formation that takes place at high electrolyte concentrations can be hindered or prevented.

The reduction of the conductivity of the cell and the deterioration of the hydrogen separation potential by a small electrolyte concentration in the cathode chamber can be counteracted by using a permeable cathode adjacent to a cation exchanger membrane provided as the separator for the intermediate chamber, by which arrangement the rise of ion concentration provided in the membrane can be utilized optimally with reference to the necessary cathode potential.

Preferably a flow-through electrode is used also in the cathode chamber, adjacent to the cation exchanger membrane and activated at least at the boundary surface. Such flow-through cathodes have the advantage that the hydrogen given off cathodically by the catholyte can be favorably carried away and, moreover, an intensified accessibility of the catholyte to the place of the actual hydrogen evolution is favored. Such flow-through cathodes should, however, not be chosen too thick, in order that the ohmic resistance of the electrode between the electrochemically active layer and the current supply at the back of the electrode may be kept low.

Porous graphite and/or carbon masses, as in particular graphite and/or carbon felts, are suitable as flow-through electrodes, or also the so-called bed electrodes such as are obtainable by a corresponding loose layering of graphite or carbon particles. An improvement of the contact effectiveness and reduction of the internal resistance of the cell results from the use of anodic and cathodic casing or housing parts of "liquid-impermeable" graphite that surround the respective flow-through electrodes, particularly when an application pressure is provided for the mechanical strength of the flow-through electrodes as a whole. Metal shells or rings are particularly suited for current supply connections, and these can at the same time perform a mechanical support function. The graphite half-casings of the cathode and anode chambers are then separated from each other by an insulating ring surrounding the separation or intermediate chamber.

The possibility of using relatively high sulfuric acid concentrations in the anode space that results by the use according to the invention of an anode-side cation exchanger membrane of relatively low conductivity and low dependence on the sulfuric acid concentration leads to the further possibility of using as the anolyte a sulfur-dioxide-containing sulfuric acid of $H_2SO_4$ content of about 40 to 60% by weight and preferably about 50% by weight $H_2SO_4$, to which preferably there is also provided in the anolyte a catalytically effective hydrogen iodide concentration which depends on the $SO_2$ concentration and must not be too small, this currently being selected, in particular, at about 0.15% HI by weight.

The use of cation exchanger membranes as separators for the intermediate chamber provides the possibility of using an intermediate chamber that is relatively narrow, such as is constituted by an intermembrane spacing between about 0.5 and 10 mm. The flow velocity of the separating (intermediate) electrolyte is then so chosen that no $SO_2$ possibly penetrating through the membrane on the anode side can get into the cathode chamber.

The flow velocities of the anolyte and catholyte are to be set according to the necessary supply rates of $SO_2$ to the anode chamber and the amount of necessary hydrogen removal from the cathode chamber.

The electrolysis cell of the invention suitable for the performance of the process above described has a cation exchanger membrane on the anode side of the intermediate chamber having a specific resistance, in 55% by weight $H_2SO_4$ at 80° C., of less than about 30 ohms-centimeters.

Preferably the cell includes a flow-through cathode applied to or adjacent to the cathode side of the membrane in sandwich fashion and a flow-through anode lying against the anode side separation membrane, the electrodes being respectively surrounded by graphite casings, which they substantially fill up, so that contact of the best possible quality is provided between the flow-through electrodes formed of porous masses or layers and the surrounding graphite, which in turn is surrounded in sheath-like fashion by a current supply member. In this manner it is possible to keep relatively low the ohmic resistances from the current supply to the gas separation location with the use of flow-through electrodes, particularly out of graphite. For insulation between the anodic and cathodic casing parts, an insulation ring surrounding the intermediate chamber is then provided. According to the invention, diminution of the internal resistance of the electrolysis cell and at the same time a sufficient protection of the cathode from poisoning by sulfur are obtained by the particular anode-side cation exchanger membrane of low conductivity and of low conductivity dependence on the electrolyte concentration. There is furthermore also obtained an optimization of the entire cell and electrolysis, by the combined selection of particularly suitable configurations of the structural elements of the cell and of suitable electrolyte concentrations.

BRIEF DESCRIPTION OF THE DRAWINGS

The invention is now further described by way of illustrative example, with reference to the annexed drawings, in which.

DESCRIPTION OF A BACKGROUND EXPERIMENT

Figure 1:
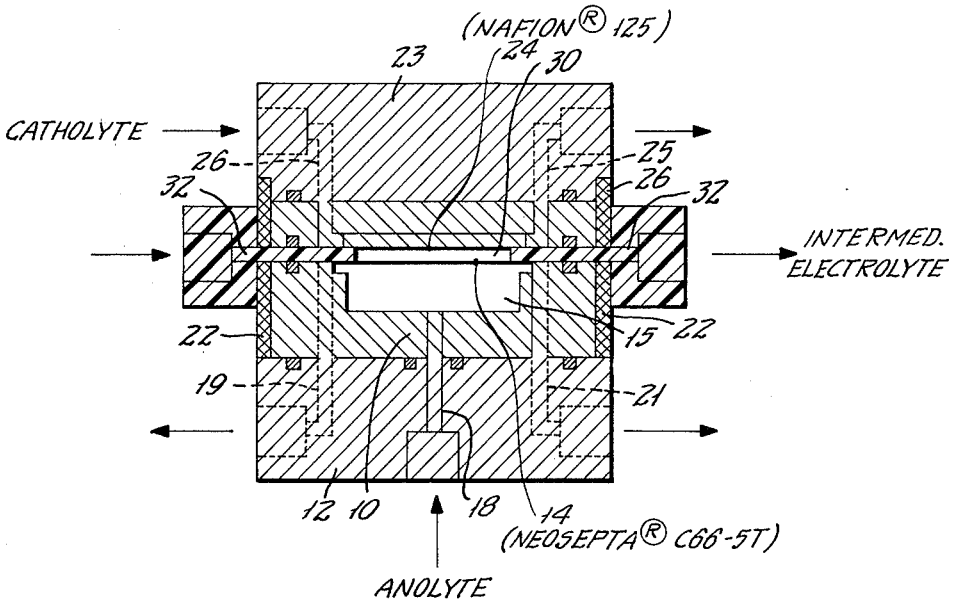
FIG. 1 is a diagrammatic horizontal cross-section of a first embodiment of an electrolysis cell.

A three-chamber electrolytic cell of the kind illustrated in FIG. 1, except that both membranes were of Nafion ® 125, was operated under the following conditions:

The electrolyte was sulphuric acid. The concentration of sulfuric acid was 50 percent by weight in the anode chamber and 1 percent by weight in the cathode chamber. The sulfuric acid concentration in the intermediate chamber varied between 5 and 35 percent by weight. A homogeneous cation exchanger membrane was provided between the anode chamber and the intermediate chamber (as shown in FIG. 1) of the commercial type designation Nafion ® 125, a perfluorinated polyethylene (oxide) with $SO_3H$ groups, and likewise another such membrane between cathode chamber and intermediate chamber. The anode was a graphite felt through which the electrolyte flowed, the graphite felt being of the commercial type Sigri GFA ® 10 of coked polymer fiber material.

This graphite felt electrode lay against the membrane and the flow went through the electrode in a direction running along the surface of the membrane. The "PVDF" material mentioned in connection with FIG. 1 is polyvinilidene fluoride.

Figure 2:
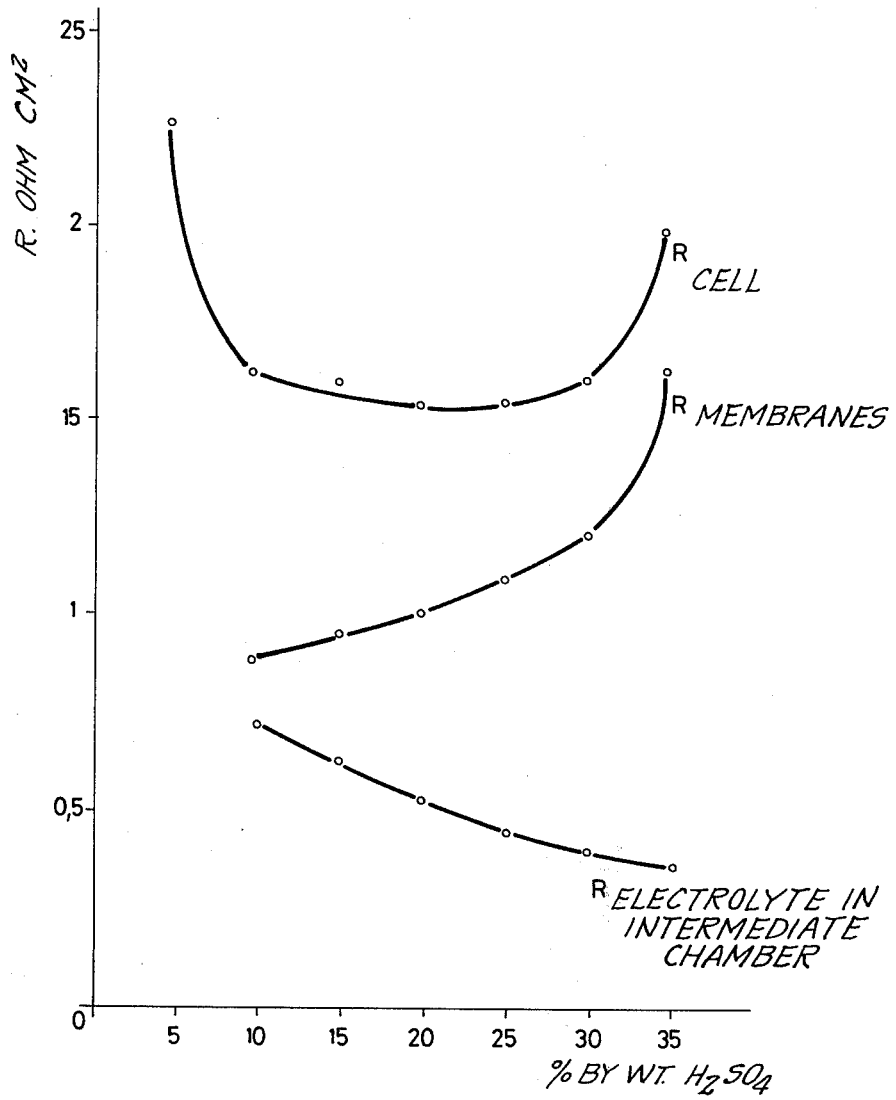
FIG. 2 is a graphical illustration of the relation between the area resistance in ohm.cm$^2$ to the percentage by weight of sulfuric acid in the electrolyte, for the cell, and the intermediate chamber electrolyte, and for the membranes, all for a cell of the prior art.

The anolyte was mixed with 0.15 percent by weight of HI acting as a homogeneous catalyst. The $SO_2$ pressure in the anolyte was 1 bar. The cathode was a flow-through electrode of graphite felt GFA ® 10 lying against the membrane, the felt body being platinized on the side lying against the cathode membrane. The temperature was 88° C. The resistance behavior in dependence upon the sulfuric acid concentration in the intermediate chamber is given in FIG. 2.

EXPERIMENTS ILLUSTRATING THE INVENTION

Comparative measurements were also made of the respective resistance of a homogeneous cation exchanger membrane made of the commercial product Nafion ® 125 and of a heterogeneous cation exchanger membrane made of the commercial product Neosepta ® C 66-5T, the latter being a subsequently sulfonated styrol divinylbenzol polymer that had been polymerized in the presence of polyvinyl chloride.

The specific resistance of Neosepta ® C 66-5T is much smaller than that of Nafion ® 125. The specific resistance of Neosepta ® C 66-5T increases less strongly with increasing sulfuric acid concentration than the specific resistance of Nafion ® 125, as clearly appears in the following table for 80° C.

TABLE 1

| $H_2SO_4$ CONCENTRATION (percentage by weight) | SPECIFIC RESISTANCE IN OHM . cm NAFION ® 125 | NEOSEPTA ® C 66-5T |
|---|---|---|
| 10 | 9.5 | 3.9 |
| 30 | 13.7 | 4.0 |
| 45 | 36.8 | 6.4 |
| 55 | 116 | 13 |

If now the cation exchanger membrane of Nafion ® 125 between the anode and intermediate chambers of the electrolysis cell of FIG. 1 is replaced by cation exchanger membrane of Neosepta ® C 66-5T, the resistance of the electrolysis cell shrinks from about 1.5 ohm.cm$^2$ to 1 ohm.cm$^2$, when the sulfuric acid concentration in the intermediate chamber is 30 percent by weight.

Figure 3:
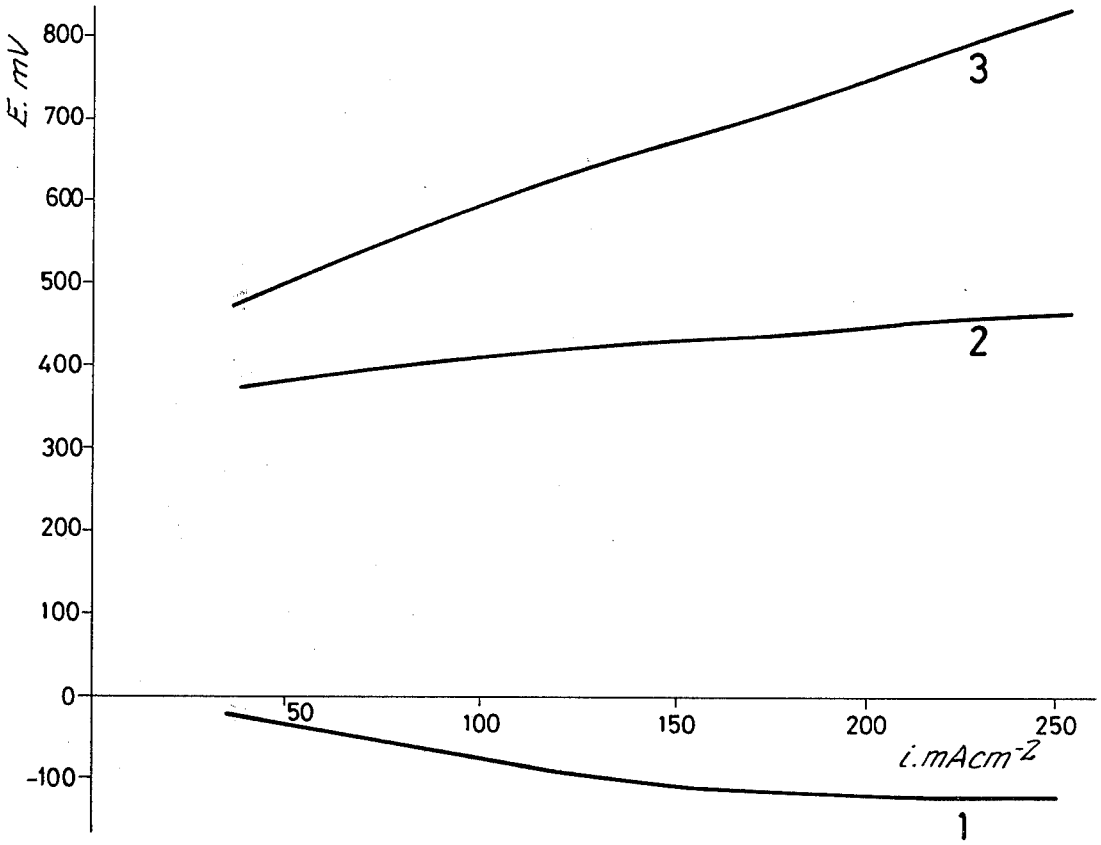
FIG. 3 is a graphical illustration of the relation between electrolysis voltage in millivolts and current in milliamperes per cm$^2$ in a cell and process of the present invention.

FIG. 3 shows the current-voltage curve respectively for the electrolysis cell as a whole (curve 3) and separately in each case for the cell utilizing different membranes on the anode and cathode sides, as desired in the preceding paragraph. The potential values of the individual electrodes are given with reference to the reversible hydrogen electrode in 50 percent by weight $H_2HO_4$ under identical conditions, as reference electrodes.

FIG. 1 shows a first embodiment of a cell according to the invention showing an anode consisting of graphite 10, backed by a block 12 of PVDF plastic, and abutting at its edges against membrane 14 to provide an anode chamber 15. The anode is girdled by a copper strap 22. An input channel 18 is provided for feeding anolyte into the chamber 15. Exit channels 19,21 are provided at the respective sides for discharge of the anolyte. The cathode is similarly backed by a body 23 of PVDF, but its porous graphite electrode 33 is right against the membrane 24 and is similarly girdled by a copper connecting strap 26. The channel 25 provides for flow of the catholyte through the electrode parallel to the surface of the membrane 24. Between the membranes 14 and 24 is the intermediate chamber 30. The intermediate electrolyte flows in a direction parallel to the flow of the catholyte through the intermediate chamber, entering at the left and exiting at the right in channels through an insulating PVDF frame 32. In the cell of the invention, as already mentioned, the anode side membrane 14 of the heterogeneous type, in the illustrated case of the commercial material Neosepta ® C 66-5T; whereas, the cathode side membrane is of the homogenous cation exchanger type in the illustrated case of the commercial material Nafion ® 125.

Figure 4:
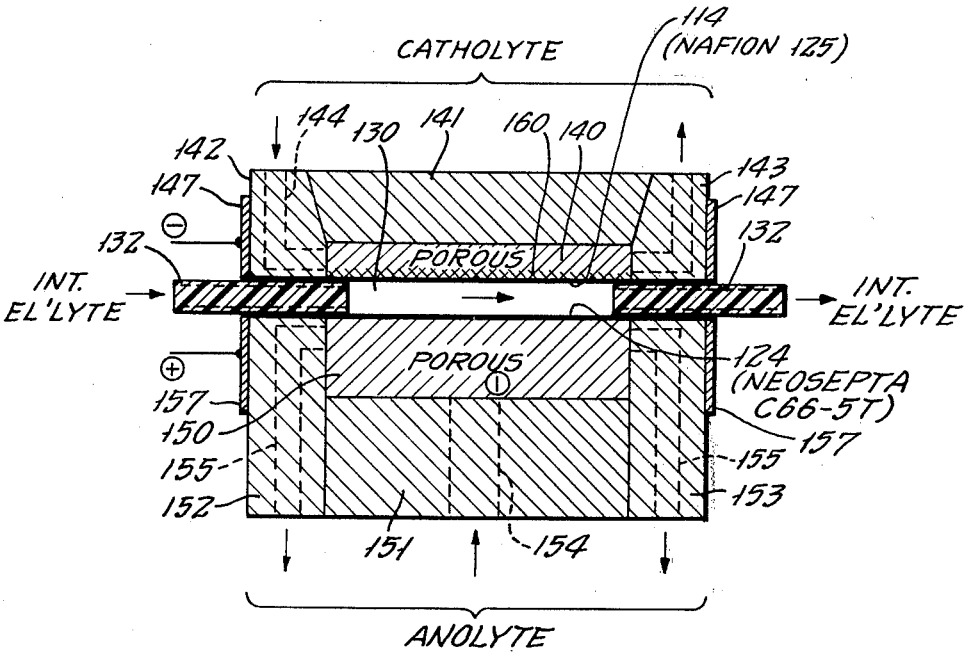
FIG. 4 is a diagrammatic horizontal cross-section of a preferred embodiment of an electrolysis cell according to the invention.

FIg. 4 illustrates a preferred type of cell in which both the cathode and the anode are porous flow-through electrodes. The cathode membrane 114 is again of a homogeneous polymer and the anode membrane 124 is again of a heterogeneous polymer, just as was the case in FIG. 1 of the membranes 14 and 24, respectively. The intermediate electrolyte again flows through an insulating frame 132 in order to get in and out of the intermediate chamber 130. The cathode flow-through electrode is provided by the porous graphite body 140, which is backed by the half-casing of impermeable graphite composed of the blocks 141, 142, and 143, the latter two of which carry channels 144 and 145, respectively, for the introduction and withdrawal of the catholyte. The top and bottom blocks corresponding to the side blocks 142 and 143 are not shown but are similarly disposed to complete the half-casing. Around the top and bottom and side blocks is a copper sleeve 147 which is connected to the negative pole of the current supply. The anode flow-through electrode is constituted by the porous graphite body 150, which is similarly backed up by impermeable graphite blocks 151, 152, and 153, as well as top and bottom blocks not shown. In this case, a channel 154 through the block 151 supplies the anolyte and channels 155 in the side top and bottom blocks carry away the anolyte. The copper sleeve 157 is connected to positive voltage.

The cathode flow-through electrode is distinguished by the fact that its layer adjacent to the membrane 114 is activated by being platinized, as symbolized by the extra shading 160.

Although the invention has been described with reference to a particular illustrative apparatus and a particular example of process, it will be understood that modifications and variations are possible within the inventive concept.

We claim:

1. A process for producing hydrogen by electrolysis of an aqueous solution containing sulfurous and sulfuric acids in a three chamber electrolytic cell having an anode chamber, a cathode chamber and an intermediate chamber therebetween separated from said anode and cathode chambers by cation-exchanger membranes, comprising the steps of:

providing as the cation-exchanger membrane on the anode side of the intermediate chamber a heterogeneous membrane of a constitution combining an inactive polymer skeleton and a hydrophillic exchanger polymer and having a specific resistance which, when measured in sulfuric acid of 55% by weight concentration at 80° C., is less than 30 ohm-cm.;

maintaining a flow through said intermediate chamber of an aqueous electrolyte containing $H_2SO_4$;

maintaining a flow of aqueous electrolyte through said cathode chamber containing a smaller concentration of $H_2SO_4$ by weight than the electrolyte in said intermediate chamber;

maintaining a flow of aqueous electrolyte through said anode chamber containing sulfurous acid and containing a greater concentration of $H_2SO_4$ by weight than the electrolyte in said intermediate chamber, and causing an electrolysis current to flow between the anode and the cathode, whereby hydrogen is evolved at the cathode, sulfurous acid is oxidized to sulfuric acid at the anode and the cell voltage remains favorably low, because of the said properties of the cation-exchanger membrane provided between said intermediate chamber and said anode chamber.

2. A process as defined in claim 1, in which said cation-exchanger membrane provided on the anode side of the intermediate chamber is made of a material prepared by the polymerization of styrol and divinylbenzol in the presence of polyvinyl chloride followed by the attachment of $SO_3H$ groups to the resulting styrol/divinyl benzol polymer.

3. A process as defined in claim 2, in which the cathode is a porous electrode in a casing of impermeable graphite on all sides thereof except the side facing the cathode side membrane of said intermediate chamber, the porous material filling the interior of said cathode chamber formed by the impermeable graphite casing and being activated at least in a layer lying alongside the cathode side membrane of the intermediate chamber, and in which process the cathode chamber electrolyte is caused to flow through the porous material of the cathode.

4. A process as defined in claim 2, in which the anode is a porous electrode in a casing of impermeable graphite on all sides thereof except the side facing the anode side membrane of said intermediate chamber, the porous material filling the interior of said anode chamber formed by the impermeable graphite casing, and in which process the anode electrolyte is caused to flow through the porous material of the anode.

5. A process as defined in claim 2, in which the electrolyte caused to flow in said intermediate chamber is an aqueous solution containing from 25 to 45% by weight of sulfuric acid.

6. A process as defined in claim 5, in which said electrolyte caused to flow in said intermediate chamber contains about 30% by weight of sulfuric acid.

7. A process as defined in claim 5, in which in the cathode electrolyte is an aqueous solution of sulfuric acid having a sulfuric acid content between 0.1 and 20% by weight and the electrolyte of the anode is a sulfur-dioxide-containing aqueous solution of sulfuric acid having a sulfuric acid content in the range from 40 to 60% by weight.

8. A process as defined in claim 7, in which the anode electrolyte has a content of hydrogen iodide which is as high as possible depending on the concurrent $SO_2$ concentration in said anode electrolyte according to the equilibrium of the Bunsen reaction in the bulk of the solution.

9. A process as defined in claim 7 or 8, in which there is a hydrogen iodide content in said anode electrolyte of about 0.15% by weight.

10. A process as defined in claim 9, in which the sulfuric acid concentration in the cathode electrolyte is between 0.1 and 10% by weight and in which the sulfuric acid concentration in said anode electrolyte is about 50% by weight.

11. A process as defined in claim 2, in which the cathode is a porous electrode in a casing of impermeable graphite on all sides except that facing the cathode side membrane of said intermediate chamber, the porous material filling the cathode chamber formed by the impermeable graphite casing and being activated at least in a layer lying alongside the cathode side membrane of the intermediate chamber, and in which process the cathode chamber electrolyte is caused to flow through the porous material of the cathode, and in which the anode is a porous electrode in a casing of impermeable graphite on all sides except that facing the anode side membrane of said intermediate chamber, the porous material filling the anode chamber formed by the impermeable graphite casing, and in which process the anode chamber electrolyte is caused to flow through the porous material of the anode.

12. A process as defined in claim 11, in which the electrolyte caused to flow in said intermediate chamber is an aqueous solution containing from 25 to 45% by weight of sulfuric acid.

13. A process as defined in claim 12, in which said electrolyte caused to flow in said intermediate chamber contains about 30% by weight of sulfuric acid.

14. A process as defined in claim 12, in which in the electrolyte caused to flow through the cathode is an aqueous solution of sulfuric acid having a sulfuric acid content between 0.1 and 20% by weight and the electrolyte caused to flow through the anode is a sulfur-dioxide-containing aqueous solution of sulfuric acid having a sulfuric acid content in the range from 40 to 60% by weight.

15. A process as defined in claim 14, in which the electrolyte caused to flow through the anode has a content of hydrogen iodide as high as possible depending on the concurrent $SO_2$ concentration in said electrolyte/caused to flow through said anode. (according to the equilibrium of the Bunsen reaction in the bulk of the solution)

16. A process as defined in claim 14 or claim 15, in which the hydrogen iodide content in said electrolyte caused to flow through said anode is about 0.15% by weight.

17. A process as defined in claim 16, in which the sulfuric acid concentration in the electrolyte caused to flow through said cathode is between 0.1 and 10% by weight, and in which the sulfuric acid concentration in said electrolyte caused to flow through said anode is about 50% by weight.

* * * * *